US010513087B2

(12) United States Patent
Aoki

(10) Patent No.: US 10,513,087 B2
(45) Date of Patent: Dec. 24, 2019

(54) PRESS MACHINE

(71) Applicant: AMADA COMPANY, LIMITED, Kanagawa-ken (JP)

(72) Inventor: Makoto Aoki, Kanagawa (JP)

(73) Assignee: AMADA COMPANY, LIMITED, Kanagawa-Ken (JP)

( * ) Notice: Subject to any disclaimer, the term of this patent is extended or adjusted under 35 U.S.C. 154(b) by 1097 days.

(21) Appl. No.: 14/371,012

(22) PCT Filed: Jan. 8, 2013

(86) PCT No.: PCT/JP2013/050102
§ 371 (c)(1),
(2) Date: Jul. 8, 2014

(87) PCT Pub. No.: WO2013/105547
PCT Pub. Date: Jul. 18, 2013

(65) Prior Publication Data

US 2014/0360388 A1 Dec. 11, 2014

(30) Foreign Application Priority Data

Jan. 10, 2012 (JP) ..... 2012-002062

(51) Int. Cl.
*B30B 1/18* (2006.01)
*B30B 15/06* (2006.01)

(52) U.S. Cl.
CPC ..... *B30B 1/181* (2013.01); *B30B 1/18* (2013.01); *B30B 15/068* (2013.01)

(58) Field of Classification Search
CPC ..... B30B 1/181; B30B 1/18; B30B 1/186; F16H 25/20; F16C 25/06; F16C 19/18–184
(Continued)

(56) References Cited

U.S. PATENT DOCUMENTS 4,196,947 A * 4/1980 Ziegler ..... B60B 33/0002 384/592
5,471,901 A * 12/1995 Nishiya ..... B21D 28/24 83/136
(Continued)

FOREIGN PATENT DOCUMENTS

DE 1427417 11/1968
EP 1570979 9/2005
(Continued)

OTHER PUBLICATIONS

Search Report issued by E.P.O. patent office in E.P.O. Patent Application No. 13735918.8, dated Nov. 23, 2015.
(Continued)

*Primary Examiner* — Jimmy T Nguyen
(74) *Attorney, Agent, or Firm* — Greenblum & Bernstein, P.L.C.

(57) ABSTRACT

In a press machine vertically moving a ram by turning a threaded member, the ram has a bearing holder that holds a bearing whose outer ring is solidly engaged with the bearing holder and whose inner ring is solidly fitted to a lower end part of the threaded member. A fine clearance is formed between a lower face of the threaded member and a bottom face of the bearing holder so that the threaded member and bearing holder are allowed to rotate relative to each other. The fine clearance is set so that, when load is applied to the ram to cause a relative slight movement in a vertical direction between the inner and outer rings of the bearing, the lower face of the threaded member and the bottom face of the bearing holder come into contact with each other.

8 Claims, 4 Drawing Sheets

(58) Field of Classification Search
USPC ..... 74/89.3, 34, 39; 100/289, 290
See application file for complete search history.

(56) References Cited

U.S. PATENT DOCUMENTS

| | | | | |
|---|---|---|---|---|
| 2005/0204798 | A1* | 9/2005 | Imaeda | B30B 1/18 72/443 |
| 2006/0283229 | A1* | 12/2006 | Futamura | B30B 1/18 72/443 |
| 2007/0251342 | A1* | 11/2007 | Murao | B30B 1/18 74/59 |
| 2012/0297848 | A1 | 11/2012 | Kishimoto et al. | |
| 2013/0291609 | A1* | 11/2013 | Furukawa | B30B 1/18 72/21.4 |

FOREIGN PATENT DOCUMENTS

| | | |
|---|---|---|
| JP | 3015038 | 6/1995 |
| JP | 2004-188460 | 7/2004 |
| JP | 3953414 | 8/2007 |
| JP | 2008-018444 | 1/2008 |
| JP | 2008-188631 | 8/2008 |

OTHER PUBLICATIONS

Search report from International Search Report in PCT/JP2013/050102, dated Apr. 2, 2013.

* cited by examiner

PRESS MACHINE

TECHNICAL FIELD

The present invention relates to a press machine including a nut member rotatably arranged on a frame, a first motor arranged on the frame to rotate the nut member, a threaded member screwed into the nut member so that the threaded member is rotatable and longitudinally movable, a second motor arranged on the nut member to rotate the threaded member, an engaging part engaged with a front end part of the threaded member so that the engaging part rotates relative to the threaded member, and a ram movable with the engaging part in a direction in which the threaded member moves. In particular, the present invention relates to a press machine capable of smoothly moving the threaded member at high speed.

BACKGROUND ART

Japanese Patent Publication No. 3953414 (Patent Literature 1), for example, proposes a press machine having a motor for vertically moving a ram at high speed and a high-power motor that functions when pressing the ram.

SUMMARY OF INVENTION

Problems to be Solved by Invention

The press machine described in the Patent Literature 1 has a configuration as illustrated in FIG. 1. Namely, the press machine 1 has a frame 3. An upper part of the frame 3 has a nut member 5 that is rotatable. The nut member 5 has a pulley 7 around which a belt 13 is stretched. The belt 13 is also stretched around a drive pulley 11 of a first motor 9 installed on the frame 3. Accordingly, forwardly or reversely turning the first motor 9 results in forwardly or reversely turning the nut member 5 in synchronization.

The frame 3 has a guide member 15 extending in a vertical direction. The guide member 15 vertically movably supports and guides a ram 17. To vertically move the ram 17, the nut member 5 has a threaded member 19 that is inserted through the nut member 5 so that the threaded member 19 is rotatable and vertically movable. To rotate the threaded member 19, an upper end part of the threaded member 19 integrally has a pulley 21. Around the pulley 21, a belt 27 is stretched. The belt 27 is also stretched around a drive pulley 25 of a second motor 23.

The second motor 23 vertically moves together with the threaded member 19. For this, the second motor 23 is vertically movably supported and guided with a vertical guide 31 of a support bracket 29 that is arranged at an outer upper part of the frame 3. The second motor 23 has a motor bracket 33 to which a base end part of a connection bar 35 is solidly connected. A front end part of the connection bar 35 is connected to the threaded member 19 so that the threaded member 19 rotates relative to the connection bar 35.

A front end part (lower end part) of the threaded member 19 is engaged with an engaging part 37 formed at an upper part of the ram 17 so that the threaded part 19 rotates relative to the engaging part 37. More precisely, the lower end part of the threaded member 19 has a flange part 19F and the engaging part 37 has an engaging recess 39 that contains the flange part 19F so that the flange part 19F may rotate. The engaging recess 39 incorporates, as illustrated in FIG. 2, a bearing 41, which restricts vertical movements of the flange part 19F, and an oil seal 43.

In a normal state with the above-mentioned configuration, the ram 17 is in a state being suspended from the threaded member 19 to form a fine clearance C between a lower face of the flange part 19F of the threaded member 19 and a bottom face (upper face) of the engaging recess 39. As a result, the threaded member 19 can smoothly rotate relative to the ram 17 as illustrated in FIG. 2(A).

When the first motor 9 is in a stopped state in this configuration, the second motor 23 may be rotated at high speed to lower the threaded member 19. This results in lowering the ram 17 also at high speed. At this time, the first motor 9 may properly be rotated in a forward or reverse direction to lower the ram 17 at higher or slower speed.

When the ram 17 is lowered as mentioned above, a punch P provided for the ram 17 comes into contact with a work W set on a die D and load is applied to the ram 17. Then, the lower face of the flange part 19F comes into contact with the upper face (bottom face) of the engaging recess 39 (refer to FIG. 2(B)), and therefore, the threaded member 19 becomes unable to rotate relative to the ram 17.

When the lower face of the flange part 19F comes into contact with the bottom face of the engaging recess 39 as mentioned above, the rotation of the second motor 23 is stopped and the first motor 9 is rotated to rotate the nut member 5 to lower the ram 17 through the threaded member 19.

In this way, by controlling the rotation of the first and second motors 9 and 23, the ram 17 can vertically be moved at high speed. When load is applied to the ram 17, the rotation of the first motor 9 lowers the ram 17 at low speed to apply large pressure to press the work W.

According to the above-mentioned configuration, if the ram 17 is in an ascended state and if the threaded member 19 is rotated at high speed to lower the ram 17 at high speed, the threaded member 19 starts to quickly descend relative to the ram 17 that is ascended and stopped. In this case, a descending speed of the ram 17 that starts to descend by its own weight may become slower than a descending speed of the threaded member 19 and the lower face of the flange part 19F of the threaded member 19 may come into contact with the bottom face of the engaging recess 39 of the ram 17.

Namely, although the ram 17 is descending and no load is being applied thereto, the lower face of the flange part 19F comes into contact with the bottom face of the engaging recess 39 to prevent the smooth rotation of the threaded member 19 during the descending of the ram 17.

Means to Solve Problems

In view of the above-mentioned problem, the present invention provides a press machine of the type that vertically moves a ram by turning a threaded member. The press machine is characterized in that the ram has a bearing holder that holds a bearing whose outer ring is solidly engaged with the bearing holder and whose inner ring is solidly fitted to a lower end part of the threaded member and in that a fine clearance is formed between a lower face of the threaded member and a bottom face of the bearing holder so that the threaded member and bearing holder are allowed to rotate relative to each other. The fine clearance is set so that, when load is applied to the ram to cause a relative slight movement in a vertical direction between the inner and outer rings of the bearing, the lower face of the threaded member and the bottom face of the bearing holder come into contact with each other.

MODE OF IMPLEMENTING INVENTION

An embodiment of the present invention will be explained with reference to the drawings. The general configuration of a press machine according to the embodiment is similar to that of the above-mentioned press machine, and therefore, the configuration of only a main part thereof will be explained. Components of the embodiment having the same functions as those of the related art are represented with the same reference marks to omit overlapping explanations.

Figure 1:
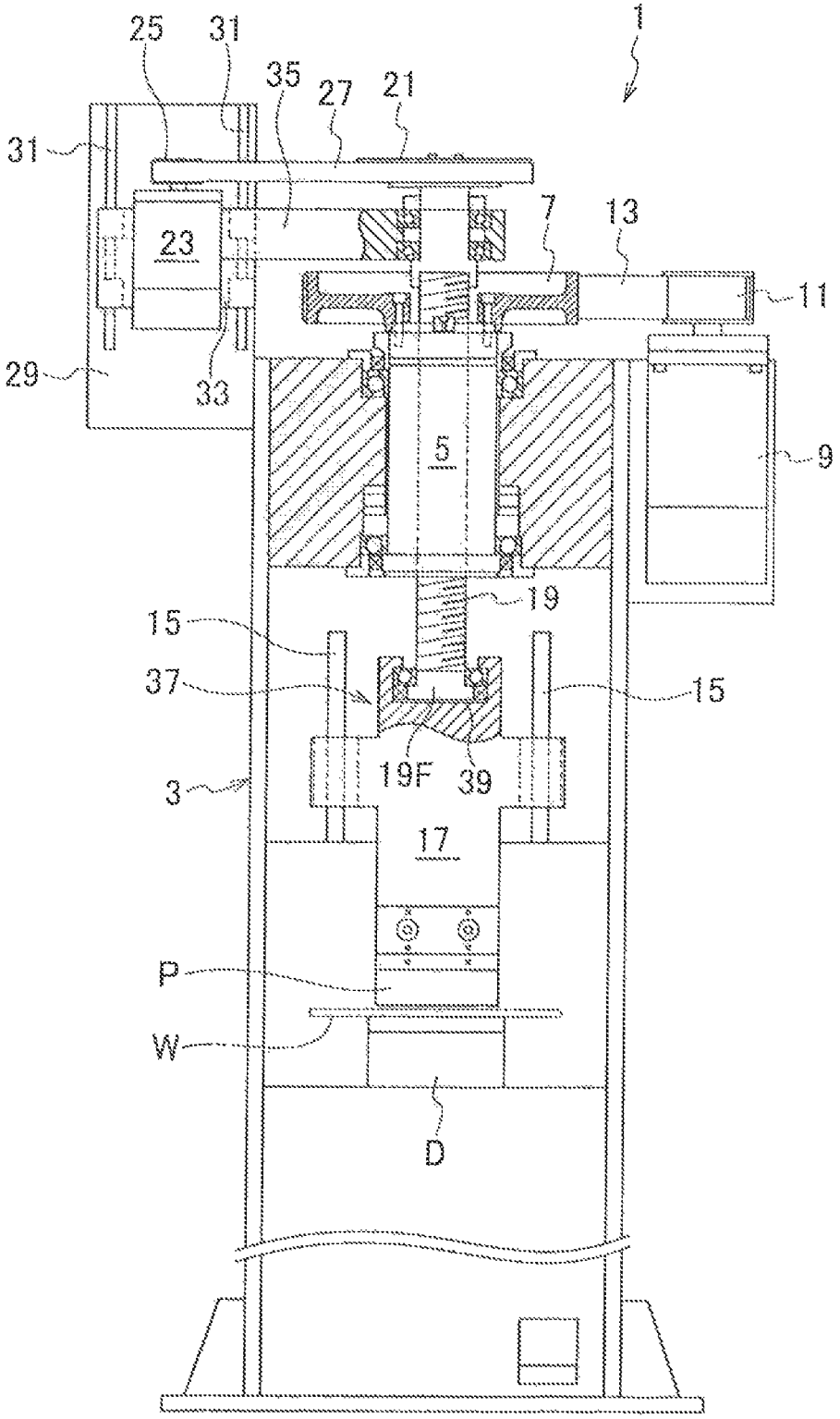
FIG. 1 PRIOR ART
FIG. 1 is a general explanatory view illustrating a press machine according to a related art.
Figure 2A:
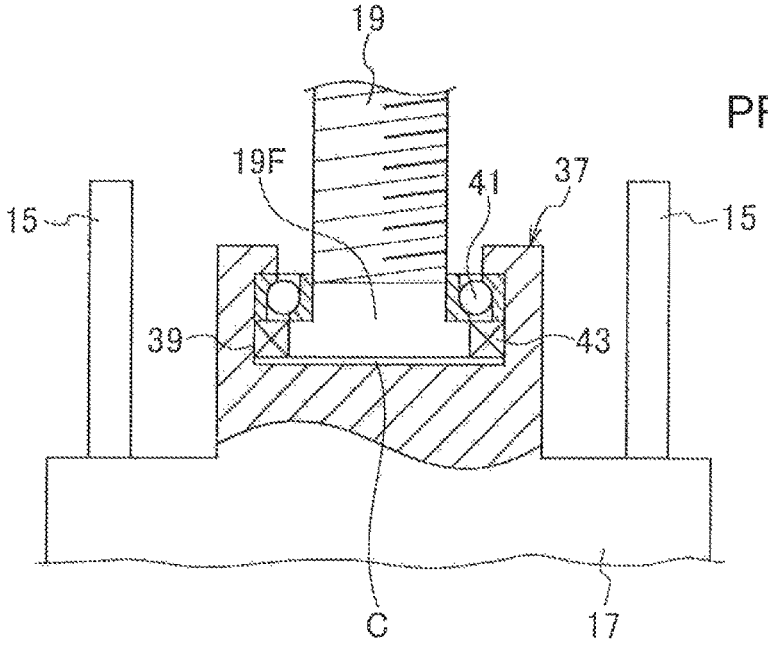
FIG. 2A PRIOR ART
FIG. 2 is an explanatory view illustrating the configuration and operation of a main part of the press machine according to the related art.
Figure 2B:
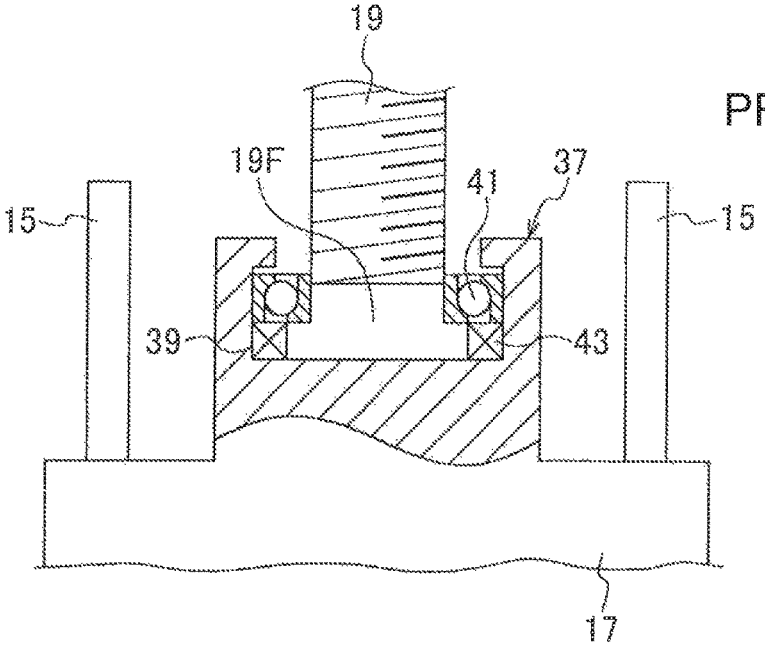
FIG. 2B PRIOR ART
Figure 3:
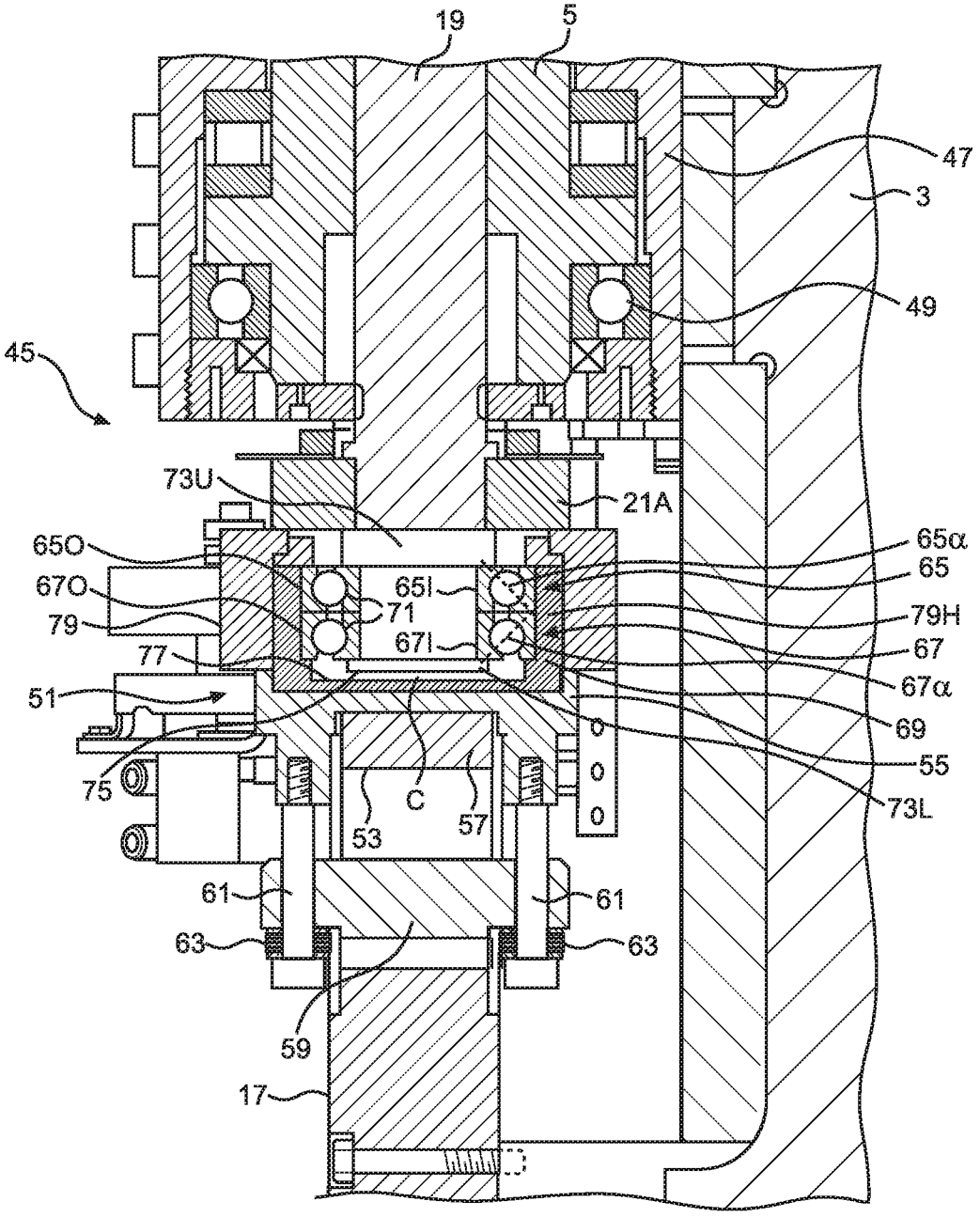
FIG. 3 is an explanatory view illustrating the configuration of a main part of a press machine according to an embodiment of the present invention.

Referring to FIG. 3, the press machine 45 according to the embodiment of the present invention has a frame 3 to which a cylindrical support block 47 is fixed. The support block 47 internally supports through a plurality of bearings 49 a nut member 5 that is rotatable. An upper part of the nut member 5 integrally has a pulley 7 (refer to FIG. 4) around which a belt 13 is stretched. The belt 13 is also stretched around a drive pulley 11 provided for a first motor 9 that is installed on a part of the frame 3. Accordingly, forwardly or reversely rotating the first motor 9 forwardly or reversely rotates the nut member 5.

Through the nut member 5, a threaded member 19 is screwed to move in a longitudinal direction, i.e., a vertical direction. A lower part of the threaded member 19 is connected to a ram 17. An upper part of the ram 17 has an engaging part 51 corresponding to the engaging part 37 so that the engaging part 51 may sway in a left-right direction (the left-right direction in FIG. 4).

Figure 4:
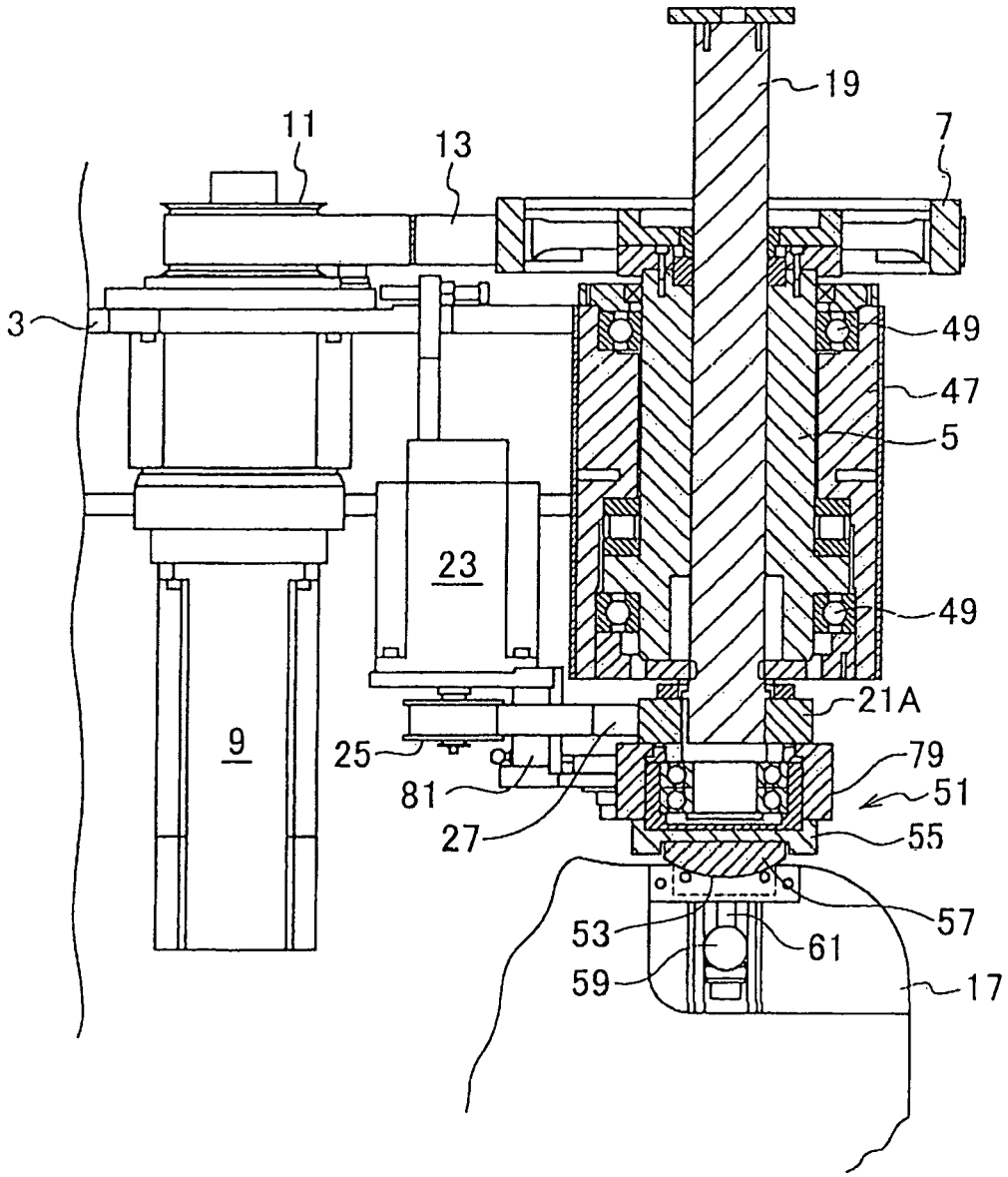
FIG. 4 PRIOR ART
FIG. 4 is an explanatory view illustrating positional relationships among first and second motors, a nut member, and a threaded member in the press machine according to the embodiment of the present invention.

In more detail, an upper face of the ram 17 has an arc-like concave face 53 formed in a front-rear direction (a direction perpendicular to the surface of FIG. 4 or a left-right direction in FIG. 3). The concave face 53 receives an arc-like convex face formed on a lower face of a swaying engaging member 57 provided for a lower face of a swayable pressurizing member 55.

To prevent the pressurizing member 55 from upwardly coming off from the upper face of the ram 17, a fixing tool 61 such as a fixing bolt vertically passes through each of front and rear ends of a through rod 59 that rotatably passes through the ram 17 in the front-rear direction.

A front end (upper end) of the fixing tool 61 is screwed into and connected to the pressurizing member 55. Arranged between a lower end head of the fixing tool 61 and the through rod 59 is an elastic member 63 such as a disk spring to downwardly push the fixing member 61.

This allows the ram 17 and pressurizing member 55 sway relative to each other in the left-right direction. The concave face 53 and the convex face of the swaying engaging member 57 may be formed into semispherical concave and convex faces to allow the ram 17 and pressurizing member 55 sway relative to each other in the front-rear and left-right directions.

To connect the lower end part of the threaded member 19 and the ram 17 to each other so that they may rotate relative to each other and vertically move together, an upper face of the pressurizing member 55 is integrally provided with a bearing holder 69 incorporating bearings 65 and 67 that are laid one on another. The bearings 65 and 67 rotatably support the lower end part of the threaded member 19. More precisely, the bearings 65 and 67 are angular bearings and the upper and lower bearings 65 and 67 are arranged so that contact angles among their inner rings 65I and 67I, balls 71, and outer rings 65O and 67O are opposite to one another. Namely, the contact angle on the upper bearing 65 is a downwardly widening contact angle and that on the lower bearing 67 is an upwardly widening contact angle. More particularly in this regard, and with reference to FIG. 3, the contact angle of the upper bearing 65 is determined by the oblique broken line 65*a* that connects the points of contact between an upper ball 71 and the inner and outer rings 65I, 65O, and the contact angle of the lower bearing 67 is determined by the oblique broken line 67*a* that connects the points of contact between a lower ball 71 and the inner and outer rings 67I, 67O.

The outer rings 65O and 67O of the bearings 65 and 67 are solidly engaged (fitted) with the bearing holder 69. Namely, the outer rings 65O and 67O of the bearings 65 and 67 are fitted to the bearing holder 69 so that the outer rings 65O and 67O are unable to vertically move relative to the bearing holder 69. The lower end part of the threaded member 19 is inserted into the inner rings 65I and 67I of the bearings 65 and 67 so that the threaded member 19 is unable to vertically move relative to the inner rings 65I and 67I. For this, a lower part of the threaded member 19 integrally has flange parts 73U and 73L to restrict the relative vertical movement of the inner rings 65I and 67I.

Through the bearings 65 and 67, the bearing holder 69 and threaded member 19 are rotatable relative to each other. When load is applied to the ram 17 during a pressing process, the threaded member 19 and bearing holder 69 are tightly connected to each other. To achieve this, a fine clearance C is formed between the lower face of the threaded member 19, i.e., a lower face 75 of the flange part 73L and a bottom face 77 of the bearing holder 69. The fine clearance C is set so that, when the pressing process creates load to upwardly push the ram 17 and elastically deform the balls 71, the lower face 75 and bottom face 77 come into contact with each other. The fine clearance C is in the order of micrometers (for example, 20 micrometers).

In a no-load state, the lower face 75 of the threaded member 19 is spaced away from the bottom face 77 of the bearing holder 69, and therefore, the threaded member 19 is rotatable relative to the bearing holder 69, i.e., the ram 17. When a punch P and a die D press a work W, load is applied to elastically deform the balls 71 and the lower face 75 and bottom face 77 come into contact with each other. In the above explanation, the bearing holder 69 is provided with the bottom face 77. If the bearing holder 69 has a through cylindrical shape, an upper face of the pressuring member 55 may serve as the bottom face 77. In this case, the upper face of the pressurizing member 55 defines the bottom face of the bearing holder 69.

An upper side of the upper flange part 73U is solidly provided with a pulley 21A corresponding to the pulley 21, to rotate the threaded member 19. An upper face of the pressurizing member 55 is solidly provided with a motor support bracket 79. The bearing holder 69 is fitted into a fitting hole 79H formed in the motor support bracket 79.

To rotate the pulley 21A, the motor support bracket 79 is solidly provided with a motor bracket 81 that supports a second motor 23. To connect and interlock the second motor 23 and pulley 21A with each other, a belt 27 is stretched around a drive pulley 25 of the second motor 23 and the pulley 21A.

In the above-mentioned configuration, if the second motor 23 is rotated at high speed in a stopped state of the first motor 9, the threaded member 19 rotates at high speed to vertically move the ram 17 at high speed. If the first motor 9 is rotated in a stopped state of the second motor 23, the nut member 5 turns to vertically move the threaded member 19. With the first motor 9 for rotating the nut member 5 and the second motor 23 for rotating the threaded member 19, the press machine of the embodiment provides functions and effects similar to those provided by the press machine of the related art.

In the above-mentioned configuration, if the second motor 23 is rotated at high speed, the threaded member 19 rotates at high speed and rapidly descends. At this time, the lower end part of the threaded member 19 and the ram 17 are rotatably connected to each other through the angular bearings 65 and 67. As a result, a downward acceleration occurring when the threaded member 19 rapidly descends is transmitted from the inner ring 65I of the upper bearing 65 through the balls 71 and outer ring 65O to the outer ring 67O of the lower bearing 67. From the outer ring 67O, the downward acceleration is transmitted through the bearing holder 69 and pressurizing member 55 to the ram 17.

Namely, at the start of the rapid descent of the threaded member 19, the ram 17 starts descending not by its own weight but by the downward push by the threaded member 19. Accordingly, there is no delay from the start of descent of the threaded member 19 to the start of descent of the ram 17 and the ram 17 smoothly follows the vertical movement of the threaded member 19.

When the punch P and die D are driven to start a pressing process to press the work W, pressing reaction acts on the ram 17, and in the bearings 65 and 67, force acts to lift the outer rings 65O and 67O relative to the inner rings 65I and 67I. The reaction (load) acting on the ram 17 during the pressing process elastically deforms the balls 71 of the bearings 65 and 67. Due to the elastic deformation, the lower face 75 of the threaded member 19 and the bottom face 77 of the bearing holder 69 come into contact with each other to create friction that makes the threaded member 19 unable to rotate.

When the rotation of the threaded member 19 becomes impossible as mentioned above, the second motor 23 stops and the first motor 9 is driven to rotate the nut member 5. This creates large pressing force to lower the ram 17.

As will be understood from the above explanation, the elastic deformation of the balls 71 of the bearings 65 and 67 that rotatably connect the threaded member 19 and ram 17 to each other makes the bottom face 77 of the bearing holder 69 containing the bearings 65 and 67 come into contact with the lower face 75 of the threaded member 19. This configuration makes the ram 17 smoothly follow the vertical movement of the threaded member 19.

According to the above-mentioned configuration, the lower end part of the threaded member 19 downwardly protruding from the nut member 5 is provided with the pulley 21A and the motor support bracket 79 arranged to turn relative to the threaded member 19 is provided with the second motor 23 for rotating the pulley 21A. This configuration suppresses an overall height of the press machine, simplifies the structure thereof, and reduces the size thereof.

The bearings 65 and 67 are not limited to the angular bearings. They may be thrust bearings. They may not be limited to the ball bearings but may be roller bearings.

According to the present invention, the fine clearance is defined between the bottom face of the bearing holder containing the bearings and the lower face of the threaded member whose lower end part is solidly fitted to the bearings of the bearing holder. The fine clearance is set so that, when load is applied to the ram to slightly vertically move the inner and outer rings of the bearings relative to each other, the bottom face and lower face come into contact with each other. Until load is applied to the ram, the bottom face and lower face never come into contact with each other, to allow the threaded member to smoothly rotate.

(United States Designation)

In connection with United States designation, this international patent application claims the benefit of priority under 35 U.S.C. 119(a) to Japanese Patent Application No. 2012-002062 filed on Jan. 10, 2012 whose disclosed contents are cited herein.

The invention claimed is:

1. A press machine comprising:

a ram and a bearing threaded member, wherein the ram is vertically moved by turning the threaded member;

the ram having a bearing holder that holds an upper bearing and a lower bearing, each of the upper and the lower bearings includes an outer ring that is engaged with the bearing holder, an inner ring that is fitted to a lower end of the threaded member, and a plurality of balls or rollers being provided between the outer ring and the inner ring;

the upper and the lower bearings being arranged so that a first contact angle of the upper bearing is opposite to a second contact angle of the lower bearing;

the first contact angle of the upper bearing being a downwardly widening contact angle and that the second contact angle of the lower bearing is an upwardly widening contact angle;

a clearance being provided between a lower face of the threaded member and a bottom face of the bearing holder so that the threaded member and bearing holder are allowed to rotate relative to each other; and the clearance being set so that, when load is applied to the ram to cause a relative movement in a vertical direction between the inner and outer rings of each of the upper and lower bearings, the plurality of the balls or rollers are elastically deformed and the lower face of the threaded member and the bottom face of the bearing holder come into contact with each other.

2. The press machine according to claim 1, wherein the bearings are thrust bearings or angular bearings.

3. The press machine according to claim 1, wherein:

a lower part of the threaded member is provided with an upper flange to restrict a relative vertical movement of the inner rings of the upper and lower bearings;

an upper side of the upper flange is provided with a pulley to rotate the threaded member;

the bearing holder is provided with a motor support bracket to support a motor having a drive pulley; and a belt is stretched around the drive pulley and the pulley.

4. The press machine according to claim 1, further comprising:

an arcuate concave face provided on an upper face of the ram; and an arcuate convex face provided below a lower face of the bearing holder;

the arcuate concave face and the arcuate convex face being configured to cooperate by enabling swaying between the ram and the bearing holder in a direction transverse to a vertical movement direction of the ram.

5. The press machine according to claim 4, wherein the arcuate concave face and the arcuate convex face are each spherical surfaces.

6. The press machine according to claim 1, a lower part of the threaded member is provided with a pulley and a motor is mounted to a motor support bracket that is rotatable relative to the threaded member, the motor configured to drive the pulley.

7. The press machine according to claim 6, the motor being mounted to the motor support bracket with a motor output shaft extending downwardly and drivingly coupled to the pulley on the lower part of the threaded member.

8. The press machine according to claim 1, wherein the outer ring of each of the upper and lower bearings is fitted into the bearing holder so as to be precluded from vertical movement relative to the bearing holder.

* * * * *